US010828681B2

(12) United States Patent
Vargas Junior

(10) Patent No.: US 10,828,681 B2
(45) Date of Patent: Nov. 10, 2020

(54) DEVICE FOR RECOVERING RESIDUES AND HOMOGENIZING FLUIDS IN A VESSEL, AND A FLUID STORAGE VESSEL

(71) Applicant: Joel Ligiero Vargas Junior, Guaratingueta (BR)

(72) Inventor: Joel Ligiero Vargas Junior, Guaratingueta (BR)

( * ) Notice: Subject to any disclaimer, the term of this patent is extended or adjusted under 35 U.S.C. 154(b) by 210 days.

(21) Appl. No.: 15/757,076

(22) PCT Filed: Sep. 2, 2015

(86) PCT No.: PCT/BR2015/050138
§ 371 (c)(1),
(2) Date: Mar. 2, 2018

(87) PCT Pub. No.: WO2017/035611
PCT Pub. Date: Mar. 9, 2017

(65) Prior Publication Data
US 2018/0236507 A1 Aug. 23, 2018

(51) Int. Cl.
*B08B 9/08* (2006.01)
*B08B 9/093* (2006.01)
(Continued)

(52) U.S. Cl.
CPC ..... *B08B 9/08* (2013.01); *B01F 5/0225* (2013.01); *B01F 5/10* (2013.01); *B05B 13/0636* (2013.01);
(Continued)

(58) Field of Classification Search
None
See application file for complete search history.

(56) References Cited

U.S. PATENT DOCUMENTS 3,645,452 A 2/1972 Stoeckel et al.
4,244,523 A 1/1981 Looper
(Continued)

FOREIGN PATENT DOCUMENTS

EP 0779111 6/1997
EP 1106269 6/2001
(Continued)

OTHER PUBLICATIONS

International Search Report prepared by the Instituto Nacional da Propriedade Industrial (INPI) dated May 19, 2016, for International Application No. PCT/BR2015/050138.

*Primary Examiner* — Cristi T Tate-Sims
(74) *Attorney, Agent, or Firm* — Sheridan Ross P.C.

(57) ABSTRACT

The invention relates to a device for recovering residues and homogenizing fluids in a fluid storing or processing vessel, the device comprising at least one fluid conduction means with a fluid inlet and a fluid outlet, through which a pressurized fluid is injected into the tank; a support base to be secured to the tank, which has a part rigidly secured to the tank, a movable part rotationally coupled to the fixed part and a guide structure for the fluid conduction means coupled to the movable part, a rotation actuator coupled to the movable part to cause it to turn together with the guide structure by up to 360 degrees around the axis of the support base, the guide structure having an articulation by means of which the guide structure is articulable by about 180 degrees around an axis of said articulation, and an articulation actuator being coupled to the guide structure to drive articulation movement of this structure.

19 Claims, 3 Drawing Sheets

(51) Int. Cl.

| | |
|---|---|
| ***B01F 5/02*** | (2006.01) |
| ***B01F 5/10*** | (2006.01) |
| ***B05B 13/06*** | (2006.01) |

(52) U.S. Cl.
CPC ..... *B08B 9/093* (2013.01); *B08B 9/0933* (2013.01); *B08B 9/0936* (2013.01)

(56) References Cited

U.S. PATENT DOCUMENTS

| | | | | |
|---|---|---|---|---|
| 5,718,382 | A | 2/1998 | Jaeger | |
| 2011/0036381 | A1 * | 2/2011 | Zilai | B05B 13/0636 134/168 R |

FOREIGN PATENT DOCUMENTS

| | | | | |
|---|---|---|---|---|
| EP | 1106269 | A1 * | 6/2001 | B01F 5/0218 |
| WO | WO 97/00142 | | 1/1997 | |

* cited by examiner

DEVICE FOR RECOVERING RESIDUES AND HOMOGENIZING FLUIDS IN A VESSEL, AND A FLUID STORAGE VESSEL

CROSS REFERENCE TO RELATED APPLICATIONS

This application is a national stage application under 35 U.S.C. 371 and claims the benefit of PCT Application No. PCT/BR2015/050138 having an international filing date of 2 Sep. 2015, which designated the United States, the disclosure of which is incorporated herein by reference.

The present invention relates to a device for recovering residues and homogenizing fluids in a vessel and to a fluid storing or processing vessel. This device is capable of delivering pressurized fluid to any region of the fluid storing or processing vessel (example, hydrocarbons in general), so as to bring about circulation of the fluid stored therein, or to extract and recover residues incrusted or deposited in the vessel, which can be reused. The invention also relates to a vessel where one or more such devices are installed.

DESCRIPTION OF THE PRIOR ART

In industries, facilities and/or oil deposits, such as refineries ships for extraction and transportation of petroleum and derivatives thereof, tanks, vessels and reservoirs are usually employed for storing or processing petroleum and other hydrocarbons.

However, as time goes by these vessels accumulate residues and solid and/or liquid components inside them, chiefly on inner surfaces of their walls, on the bottom, top or ceiling. Such residues, in some cases, exhibit high density and form slush and "sludge" that, if not removed periodically, reduces the storing or processing capability of the vessel, which is evidently undesired. The excess residues may impair the quality of the hydrocarbon. Besides, since these residues are petroleum derivatives, they have commercial value and can be recovered, treated and reused.

On the other hand, there are pieces of equipment capable of reducing the volume of slush and "sludge" and the amount of residues present on the tank bottom.

For example, patent document EP 1106269 proposes a cleaning apparatus that, generally speaking, is capable of cleaning the bottom of a tank used for storing crude oil by applying a laminar jet of fluid with high flow-rate. Such an apparatus comprises a sphere mounted on a lower portion of the tank wall, provided with an inner passage that enables pressurized fluid from a pump to reach the tank bottom. This pump reuses the crude oil coming from the tank as a cleaning fluid to remove undesired solid or liquid residues. Besides, the apparatus is also provided with an actuator capable of moving the sphere. However, since this sphere is fixed to the apparatus by means of two locking pins positioned diametrically opposite each other, it is capable of rotating only around a single central axis, because its movement in other angular directions is impossible due to the limitation imposed by these two pins.

Thus, the embodiment and constructive arrangement of the apparatus described in patent EP 1106269 restricts the rotary motion of this sphere, enabling its rotation only around a single central axis, which impairs its capability of removing slush or "sludge". So, cleaning the tank bottom becomes difficult or even impossible for some specific areas, since the apparatus is not capable of reaching the whole area of the tank bottom. Besides, the removal of residues from other parts of the tank interior, such as inner surfaces of its wall and cover or ceiling, becomes unfeasible, because it is not possible to impose a multidirectional movement, so that it can turn around multiple axes.

In the same way, patent document PCT/BR2009/000242 also relates to a device that, generally speaking, is capable of cleaning the bottom of a crude-oil storing tank by applying a laminar jet of fluid with high flow-rate. Such an apparatus also comprises a sphere mounted at a lower part of the tank wall, provided with an inner passage that enables pressurized fluid from a pump to reach the tank bottom.

Although this device is more efficient and comprehensive than the one described in patent document EP 1106269, it has limitation in 120-degree turn on three axes.

So, the embodiment and constructive arrangement of the apparatus described in patent PCT/BR2009/000242 restricts the rotary motion of the sphere, which impairs its capability of removing slush or "sludge". Thus, the cleaning of the tank bottom is also made difficult or even impossible for some specific areas, especially the tank ceiling or cover, since it is not possible to impose a multidirectional movement, so that it can turn around multiple axes.

OBJECTIVES OF THE INVENTION

An objective of the present invention is to provide a device capable of integrally cleaning all the internal parts of a vessel for storing and processing fluids, which exhibit flexibility and usability, without it being necessary to remove the vessel from its installation site, so as to eliminate costs referring to displacement and transportation thereof.

It is also an objective of the present invention to provide a device capable of recovering and removing solid and liquid residues from any region of the surfaces of inner walls, bottom and cover of a vessel for storing and processing fluids (example, hydrocarbons), in a simple and efficient manner with a powerful and directed laminar jet of fluid with high flow-rate, which can be moved and oriented within the vessel independently of the feeding source of pressurized fluid.

It is a further objective of the present invention to provide a device capable of delivering fluid to tanks for storing and processing fluids (example, hydrocarbons in general), which can remain installed inside the vessel, without the need for complex installing, sealing and uninstalling operations.

It is also an objective of the present invention to provide a device capable of enabling circulation of the fluid stored in the vessel, to obtain mixtures of various components with a higher degree of homogeneity.

It is another objective of the present invention to provide a vessel for storing fluids (example: hydrocarbons in general), provided with a device capable of delivering fluid for cleaning and/or circulating the fluid stored as mentioned above.

BRIEF DESCRIPTION OF THE INVENTION

The objective of the invention are achieved by means of a device for recovery of residues and homogenization of fluids in a vessel, the device comprising at least:

- fluid conducting means with a fluid inlet and a fluid outlet, through which a pressurized fluid is injected into the vessel;
- a support base to be fixed to the vessel, which is provided with a central bore that communicates with the fluid inlet of the fluid conduction means, wherein:

the fluid conduction means is flexible and preferably has a length at least 7 times as long as its diameter;

the support base has a fixed piece to be rigidly fastened to the vessel, a movable piece rotationally coupled to the fixed piece, and a guide structure for the fluid conduction means coupled to the movable piece;

a rotation actuator is coupled to the movable piece to cause it to turn together with the guide structure by up to 360 degrees around the axis of the support base;

the guide structure has an articulation by means of which the guide structure is articulable by up to 180 degrees around the axis of said articulation; and an articulation actuator is coupled to the guide structure for driving the articulation movement of the guide structure.

The articulation actuator may be one from a pneumatic actuator, a hydraulic actuator, an electric actuator and a manual actuator with an end coupled to the movable piece and an end fixed to the articulation.

The guide structure preferably has two parallel proximal arms secured to the movable piece and two parallel distal arms secured each to a proximal arm, through said articulation, wherein said fluid conduction means extend between the proximal and distal arms of the guide structure, and their fluid outlet is coupled to the end of the distal arms opposite the articulation with proximal arms. The articulation actuator may be a rod with an end secured to one of the distal arms and an opposite end extending out of the vessel, coupled to a crank.

The fixed piece of the support base comprises a flange fixed directly to the inner surface of the vessel by means of one from screws, rivets and soldering, and a tubular portion that extends from the flange, and the movable piece has a tube segment that is rotationally coupled to the tubular portion of the fixed piece.

Preferably, the rotary actuator is coupled to the fixed piece and to the movable piece of the support base and has a driving mechanism, which comprises an electric control, either pneumatic or hydraulic, and one from a gear, belt and driving chain to turn the movable piece with respect to the fixed piece, which engages with a gear mechanism of the movable piece. More preferably, the rotary actuator has an electric control secured to the fixed piece, and a gear chain driven by the electric control, which engages with gear teeth on the outer surface of the movable piece.

The objectives of the invention are also achieved by means of a fluid storing vessel that comprises at least one device for recovering residues and homogenizing fluid of the type described herein, which is installed inside the vessel, with the fixed piece of the support base being rigidly secured to the vessel. The fluid inlet of the fluid conduction means of the device preferably communicates with an external source of pressurized fluid through a rigid tube. The vessel may be a hydrocarbon processing and storing tank, among others.

BRIEF DESCRIPTION OF THE DRAWINGS

The present will now be descried in greater detail with reference to an example of embodiment represented in the drawings. The figures show:

FIG. 1.*a* is an enlarged view of the device installed on the vessel of FIG. 1;

DETAILED DESCRIPTION OF THE FIGURES

The invention described herein relates to a device for recovering residues and circulating fluid applied to a vessel. By "vessel" one should understand any fluid-holding container, which includes vessels for storing and/or transporting fluids, tanks used for storing and/or processing fluids, among others.

Figure 1:
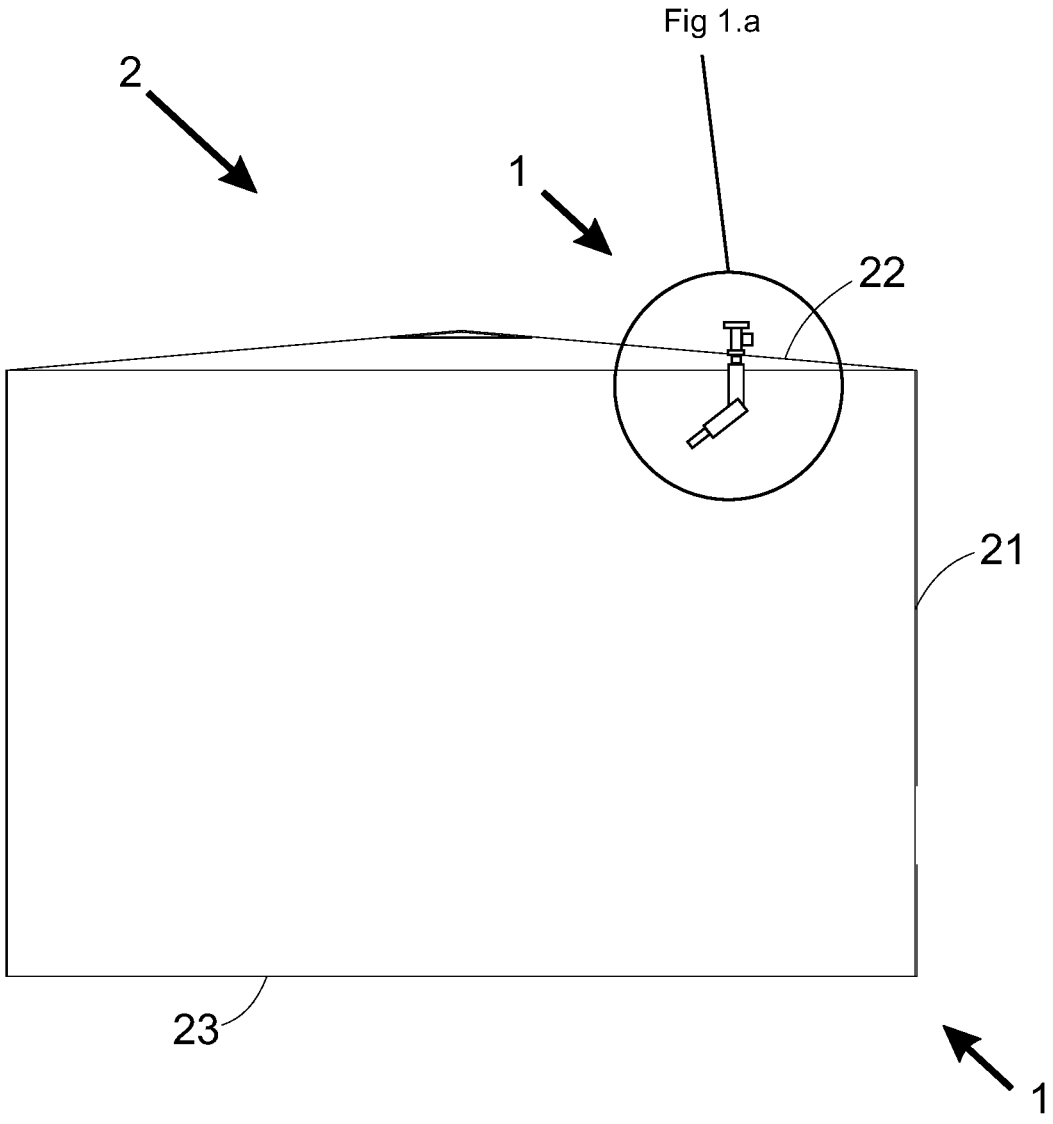
FIG. 1 is a cross-sectional front view of a fluid storing vessel, on which a device for recovering residues and recirculating fluid according to the invention is installed.

FIG. 1 illustrates the fluid processing or storing vessel 2, which according to an embodiment of the invention can be used for storing petroleum (crude oil) and derivatives thereof, comprising at least one circular peripheral wall 21, a cover or ceiling 22 and a bottom 23 associated to each other, forming a closed storage environment. This vessel usually has a very large volume and is used continuously and for prolonged periods of time for storing and homogenizing hydrocarbons in general, generating accumulation of impurities and residues such as sludge, which can be reused. So, the use of a device 1 for recovering residues and circulating fluid is especially advantageous for this type of application in industry. The present invention can be applied to tanks and vessels for storing or processing any other type of fluid in any type of facilities, including ships and platforms for producing and transporting oil.

Figure 2:
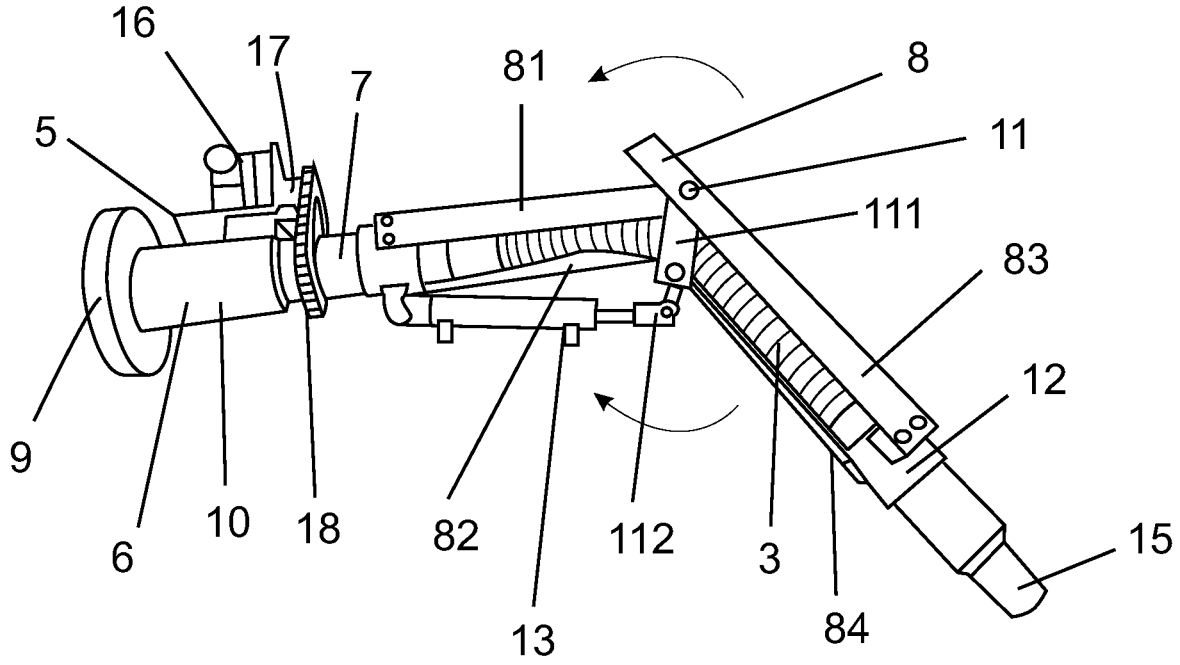
FIG. 2 is a first perspective side view of an embodiment of the device for recovery of residues and homogenization of fluid according to the invention.
Figure 3:
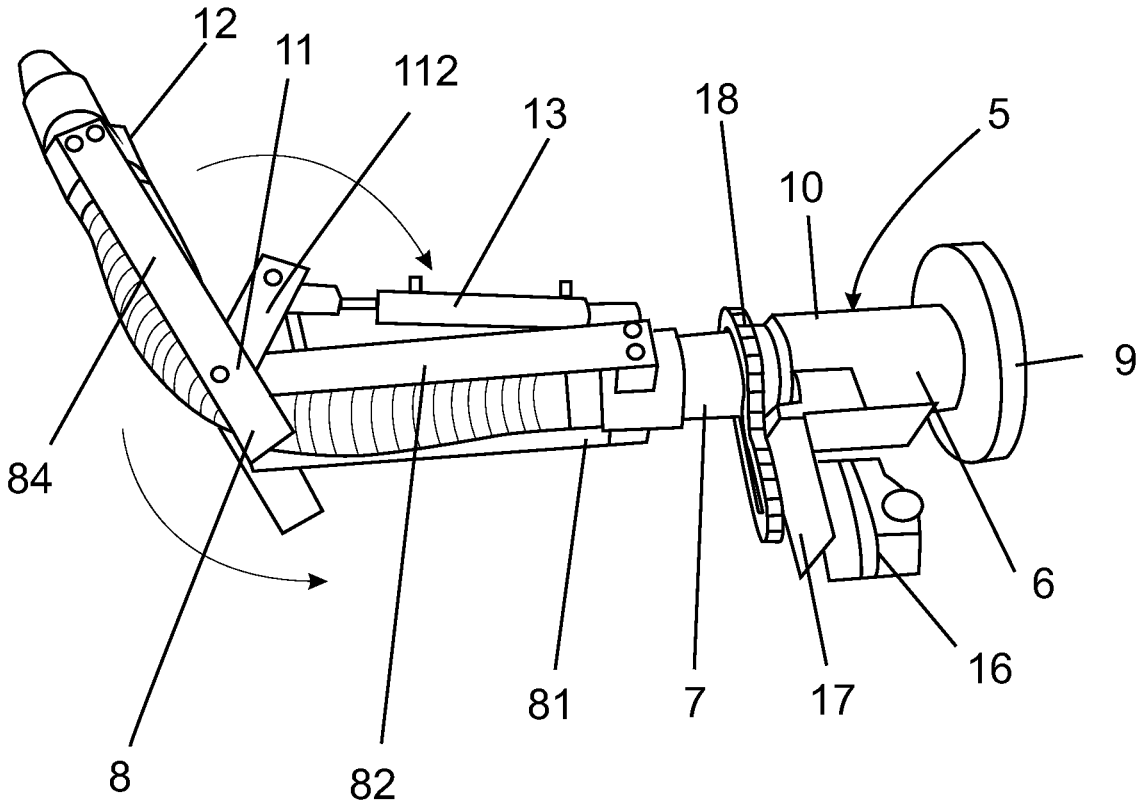
FIG. 3 is a view of second perspective side view of the device shown in FIG. 2.

The device 1 for recovering residues and homogenizing fluids, which is clearly shown in the detail of FIG. 1.*a* and in FIGS. 2 and 3, comprises at least one fluid conduction means 3 with a fluid inlet and a fluid outlet, through which a pressurized fluid is injected into the tank 2. The fluid may consist of the product itself that is stored in the tank, such as oil, water, chemical products or any liquid that enables removal of solid or liquid residues, as for example incrustations, slush or "sludge", which may be present in any internal part of the tank (inner surface of its wall 21, cover or ceiling 22 or bottom 23).

It is known from the fluid engineering that fluid in laminar regime provides low loss of load and, as a result, greater energy conservation. In order for this flow mechanism to take place, there must be a minimum straight length after each accessory installed in the tubing (reduction-, knee- or T-tubing), so that the laminar flow is reinstated after passing through this accessory. Depending on the type of accessory, this length is up to 7 times as long as the diameter of the tubing used.

In order for the efficient homogenization of the fluid inside the vessel to take place, as well as the solubilization or removal of the sludge present, a very high force is required to move and remove the whole existing mass, which sometimes is equivalent to a number of tons of stored product.

Therefore, in comparison with other technologies that adopt three-dimensional mixers of low volume and high loss of load, due to the presence of movable parts, as is the case of the pieces of equipment shown in EP 1106269 and PCT/BR2009/000242, the device according to the invention enables laminar pumping in large diameters, providing a high-thrust flow with maximum utilization of energy.

The fluid conduction means 3 is preferably a tube that has a length at least 7 times as long as its diameter, in order to provide laminar flow of the pressurized fluid at the outlet of the device. For example, if the conduction means is constituted by tubing that has 5 inches in diameter (12.7 cm), then it should have a length longer than or equal to 35 inches (88.9 cm) or more. This embodiment of the fluid conduction means with a long length enables one to achieve greater jet power, which increases the efficiency of the device, since when it is used to homogenize the fluid or to remove the sludge from a tank and recover the remaining residue the jet power and the stirring are the most important requirements to cause the sludge to dissolve better. Therefore, the fluid jet coming out of the device needs to have pressure, flow-rate and must be a long directional jet without loss of load. All these effects are only achieved by using a long conduction means with a ratio between the length and diameter of 7:1 or greater, which is not achieved with prior-art equipment.

Preferably, the fluid conduction means 3 is a flexible hose to facilitate the rotation movements and articulation carried out by the device according to the invention. This flexible fluid conduction means enables a 180-degree turn around the vertical axis, which, associated to the 360-degree rotation on the horizontal axis, enables the directional jet of the device to reach as far as the portion of the vessel located behind the device, enabling the fluid to reach the whole internal extent of the tank or vessel (bottom, ceiling and wall).

This flexible fluid conductor means extends inside the part that makes these rotation movements and articulation of the device according to the invention. The inlet of the fluid conductor means communicates with the source of fluid (not shown in the figures), which provides the pressurized fluid of the device 1. The source of fluid consists preferably of a pump that, in turn, has its inlet associated, for example, to the tank 2, which enables circulation and homogenization of the fluid stored in the tank 2. Optionally, the source of fluid (example: a pump) may have its inlet associated to a reservoir of water or some suitable chemical product. In some cases, the tank is emptied and diesel or another chemical product is applied into it, in order to dissolve the "sludge".

The communication between the fluid inlet of the fluid conduction means 3 and the source is made by means of tubes, ducts and/or rigid connectors, arranged out of the tank and that will not be moved together with the movement of the device 1.

This is also one more advantage over prior-art documents EP1106269 and PCT/BR2009/000242, in which, in order to turn the sphere one has to use flexible hoses that frictions the floor, exposing the equipment to potential risk of disastrous leakages out to the environment.

The outlet of the fluid conduction means 3 is connected to at least one injection nozzle 15, through which the fluid is injected and distributed in a pressurized manner into the vessel 2.

As can be seen in FIGS. 2 and 3, the device 1 for recovery of residues and recirculation of fluid further comprises a support base 5, by means of which the device is fixed inside the vessel. This support base has a central bore, which communicates with the fluid inlet of the fluid conduction means 3 of the device and with the source of pressurized fluid, so that the is fed to the device 1 through this bore and flows through the fluid conduction means 3 to be injected into the tank.

The support base 5 has a fixed part 6 to be rigidly secured to the tank, a movable part 7 coupled rotationally to the fixed part 6 and a guide structure 8 for the fluid conduction means 3 coupled to the movable part 7.

The fixed part 6 of the support base 5 comprises a circular flange 9 that has threaded bores for screwing the flange to the vessel, enabling permanent installation of the vessel, without the need to install and uninstall the device a number of times according to the demand for use. If the device is welded directly to the tank wall, there is no need for threaded bores in the flange.

The need for sealing components between the device and the tank is eliminated by means of this construction. The fixation of the support base 5 to the inner surface of the vessel 2 may be made directly by means of screws, rivets or any other suitable mechanical means, or still by means of soldering, without the need for other sealing means or parts, in order to prevent leakage of fluid.

This fact is a new advantage over patent documents EP1106269 and PCT/BR2009//000242, since no rotary part are exposed out of the tank, thus eliminating the risk of leakages to the environment, potentially caused by sealing failures (gaskets) of the sphere existing on those devices.

The support base further has a tubular portion 10 that extends from the flange 9 into the tank, when the device is installed. This tubular portion 10 may be welded or molded together with the flange 5, also to guarantee tightness of the device. The tubular portion 10 preferably has rotary fitting means at its end opposite the flange, where the movable part of the support base is coupled. These rotary fitting means are preferably arranged on the inner surface of the tubular portion and may be any type of connection of element that enables rotation movement of the movable part 7 with respect to the fixed part 6, or, for example, a stop element that contacts the rotary fitting means of the movable part that will be described hereinafter.

The movable part 7 is constituted by a tubing segment that is rotationally coupled to the tubular portion of the fixed part 6. In the embodiment of the invention shown in FIGS. 2 and 3, this tubing segment has an outer diameter compatible with the inner diameter of the tubular portion 10 of the fixed part 6, so that an end of the tubing segment of the movable part 7 remains engaged at the end of the tubular portion 10 opposite the flange 9 of the fixed part 6. This engagement end of the tubing segment of the movable part 7 with the tubular portion 10 has rotary engagement means coupling and cooperating with the engagement means of the tubular portion 10 of the fixed part 6, as for, example roller-bearings or slide-bearings, or any other type of engagement connection that enables rotation movement between the two parts. If necessary, a sealing ring may be coupled to the connection between the movable part and the fixed part, to prevent leakage of fluid.

The guide structure 8 of the base part 5 has two parallel arms 81, 82 with an end secured to the movable part 7, called proximal arms. Preferably this fixation of the proximal arms 81, 82 is made in a rigid rotation-proof manner and without articulation, by means of soldering, pins or screws that are secured to the end of the tube segment of the movable part 7 opposite its coupling to the fixed part 6.

The guide structure 8 further has two more arms called distal arms 83, 84, which also extend parallel to each other. These two distal arms 83, 84 are each secured to a respective proximal arm 81, 82 by means of an articulation 11, which enables articulated movement of the proximal arms 81, 82 with respect to the distal arms 83, 84. In the embodiment of the invention shown in FIGS. 2 and 3, this articulation is in the form of a pin or the like, which passes through the bore in the end of each of the proximal arms 81, 82 and a bore at the end of the respective distal arm 83, 84, the two bores being aligned with each other. The articulations of the proximal arms 81, 82 with their respective distal arms 83, 84 are aligned with each other, forming an articulation axis. A single pin or rod may be used to fix the two proximal arms to the respective distal arms, passing through the guide structure and constituting the articulation axis itself. Alternatively, one may other types of articulation that enable the same articulated movement between the proximal arms 81, 82 and their respective distal arms 83, 84. This articulation enables the guide structure to be articulable by up to 180 degrees around said articulation axis.

The parallel arms 81, 82, 83, 84 of the guide structure 8 form a way between them, which will serve as a guide and support for the fluid conduction means 3, which is arranged and extends between these proximal and distal arms with the fluid inlet facing the fixed part 6 and the tube segment of the movable part 7, and the fluid outlet facing the ends of the distal arms 83, 84 opposite the articulation 11 with the proximal arms 81, 82. This structure with arms enable one to arrange with necessary support a fluid conduction means 3 that is considerable long and can be articulated, which makes it possible to use a fluid conduction means with a length longer than or equal to 7 times as long as its diameter. In order to adapt the device according to the invention to variations in length of the fluid conduction means 3, it is enough to modify the length of the arms 81, 82, 83, 84.

As can be seen in FIGS. 2 and 3, preferably the support element 12 for the nozzle 15 of the fluid conduction means is secured to the ends of the distal arms 83, 84 opposite the articulation. The nozzle 15 is engaged with and rests on this support element 12, which is preferably in the form of a ring. Since the fluid conduction means is coupled to the nozzle 15, this guarantees that the guide structure will dully conduct the fluid conduction means and the jet out of the fluid outlet throughout the articulation movement.

An articulation actuator 13 is coupled to the guide structure 8 to actuate articulation movement of the guide structure 8. The articulation actuator 13 may be a hydraulic, pneumatic or electric cylinder, with an end coupled to the movable part or to the guide structure on the side of the proximal arms 81, 82 and an opposite end secured to the articulation 11. In order to facilitate the coupling of the cylinder, in the embodiment of the invention, two fixation arms 111, 112 are coupled to the articulation 11 of the guide structure, to which one of the ends of the cylinder 13 is secured. The actuation of the articulation 11 by means of the cylinder 13 enables one to move the fluid outlet of the device back and forth in the interval of 180 degrees, which enables one to direction the jet to the ceiling 21 and to the side walls 22 of the tank as well.

The articulation actuator may be a pneumatic, electric or even manual one. In an alternative embodiment of the invention (not shown), the articulation actuator consists of a rod with an end secured to one or both distal arms and the opposite end extends out of the tank. This opposite end of the rod may be either free or coupled to a crank, by means of which an operator actuates manually the articular movement of the guide structure around the articulation axis and directions the jet of fluid in the desired orientation.

Besides the articulation movement, the device according to the invention makes a rotation movement around the axis of the fixed part 6 of the support base 5, due to the rotation of the movable part 7 with respect to the fixed part 6. In order to provide this movement, a rotation actuator is coupled to the movable part 7 to cause it to turn together with the guide structure 8 by up to 360 degrees around the axis of the fixed part 6 of the support base 5. This rotation actuator may also be actuated in any form, for instance, in an electric, manual, hydraulic, pneumatic or mechanical way, among others, as long as it enables a complete 360-degree rotation of the movable part with respect to the fixed part.

Preferably, the rotation actuator is simultaneously coupled to the fixed part 6 and to the movable part 7 of the support base and has a drive mechanism through gears, chain or belt to turn the movable part with respect to the fixed part, wherein the actuated part is connected to the fixed part, and one actuated part is arranged on the movable part. The actuated part is controlled by an electric, hydraulic or pneumatic control, which is also secured to the fixed part 6 of the support base, and this actuated part is coupled to the actuated part of the movable part 7. This actuated part may be formed integrally on the outer surface of the movable part, for instance, in the form of gear teeth, or it may be a gear coupled to the movable part.

In the embodiment of the invention shown in FIGS. 2 and 3, a drive gear 17 controlled by the electric motor 16 is coupled to the fixed part 6, and a toothed chain 18 is coupled to this drive gear and to the driven gear of the movable part (for example, gear teeth on the outer surface of the movable part), and is responsible for transferring the rotation movement of the drive gear 17 to the movable part 7. This simple and inexpensive arrangement is quite efficient to cause the movable part to turn 360 degrees around the axis of the fixed part. Besides, since the fluid conduction means extends only within the movable components of the device (preferably only within the guide structure 8), it can be turned freely as many turns as necessary, without this causing torsion or damage to its structure. Besides, the fluid conduction means 3 is preferably made from a flexible and possibly corrugated material, therefore a light-weight material that does not interfere considerably with the power necessary to move the movable part of the device according to the invention, in both rotation and articulation movement.

In the embodiment of the invention shown in FIGS. 2 and 3, the proximal arms 81, 82 of the guide structure are secured to the tube segment of the movable part 7 aligned with the axial axis of this movable part, whereas the articulation 11 of the guide structure is formed around an axis perpendicular to said proximal arms 81, 82. In this way, the articulation axis is perpendicular to the rotation axis of the device. Thus, the association of the rotation movement by 360 degrees with the articulation movement by 180 degrees on perpendicular axis enables one to direction the fluid jet to reach and cover the whole internal area of the tank. This technical effect was not achieved by any prior-art piece of equipment, since all of them have angular displacement limitations.

Besides, since the fluid conduction means 3 is separated and independent of the fluid conductor of the source of pressurized fluid, this enables it to be moved and turned also independently and without causing rotation of the conductor of the source of fluid. As a result, it may be made from a different material and with a different structure, flexible and/or corrugated-shaped, with respect to the conductor of the source.

The combination of the above-described factors also aims at the construction of a device with a fluid conductor whose length is 7 times as long as the diameter, and so one achieves a laminar flow of fluid with higher power and better directioning than those obtained in the prior art, and that can be directioned to any point of the internal area of the tank, thus providing pressurized fluid in parts of the tank that were unreachable before.

The present invention also relates to a fluid-storage vessel 2 that comprises at least one device 1 for recovering residues and recirculating fluid of the type described herein, which is installed inside the tank, with the fixed part of the support base 5 being rigidly secured to the tank. Then, the fluid inlet of the fluid conduction medium 3 of the device 1 communicates with a source of pressurized fluid outside the tank.

The device 1 according to the invention can be used for both circulating the fluid contained in the tank, so as to act as a mixer, and cleaning the internal portions of the tank, as well as for dissolving the sludge accumulated in the tank, which is then drained out of the tank, processed and recovered to be used as another petroleum derivative.

The use of this device as a mixer is particularly advantageous in the petroleum processing industry, since at refineries the tank may receive different types of oil and it is necessary to make, inside them, a homogeneous blend of the types of petroleum to refine them subsequently. The device according to the invention can be used in closed circuit within the vessel to inject the contents of the tank into it in a pressurized manner, bringing about movement of the fluid within the tank, which helps to homogenize the blend. The homogenization is further improved by virtue of the possibility of directioning the jet of fluid to all directions, and thus it is possible to control the flow movement within the blend in a more efficient manner.

The device according to the invention can be used to keep and clean the tank at determined moments, being installed and uninstalled easily depending on the convenience, since it dispenses with the need for complex sealing. The device may still be installed in a permanent way inside the vessel, since the whole equipment is located inside the vessel, only a valve installed outside the tank being necessary for connection of the source of pressurized fluid.

Even though the device 1 of the present invention is applied preferably to vessels for storing petroleum, it can be used for other types of vessel and tank that store or process other kinds of fluid, including even tanks installed on ships. One can use the device 1 also for cleaning equipment in general.

The device according to the invention can be controlled remotely, for instance, through command signals sent by a remote control central, which determine and control the rotation and articulation movements in a combined manner according to the desired functionality of the device, be it for mixing and homogenizing the contents of the tank, or for cleaning it and recovering the residues inside the tank. The control of operation of the device can be made in an automatic manner, by means of a pre-established routine. This remote and automatic control is only possible, since the device according to the invention enables the fluid conduction means 3 to be turned independently of the pressurized-fluid feeding tube, and so there is no need to control the movement of this feeding tube as well.

A preferred example of embodiment having been described, one should understand that the scope of the present invention embrace other possible variations, being limited only by the contents of the accompanying claims, which include the possible equivalents.

What is claimed is:

1. A device for recovering residues and homogenizing fluids in a vessel, the device comprising at least:

a fluid conduction means with a fluid inlet and a fluid outlet, through which a pressurized fluid is injected into the vessel;

a support base to be secured to the vessel, which is provided with a central bore that communicates with the fluid inlet of the fluid conduction means, wherein: the fluid conduction means is flexible;

the support base has a fixed part to be rigidly secured to the vessel, a movable part coupled rotationally to the fixed part and a guide structure for the fluid conduction means coupled to the movable part;

a rotation actuator is coupled to the movable part to cause it to turn together with the guide structure by up to 360 degrees around the axis of the support base;

the guide structure has an articulation by means of which the guide structure is articulable by about 180 degrees around an axis of said articulation;

an articulation actuator is coupled to the guide structure to actuate the articulation movement of the guide structure; and the guide structure has two parallel proximal arms secured to the movable part and two parallel distal arms secured each to a proximal arm of said articulation, the fluid conduction means extending between the proximal and distal arms of the guide structure, and the fluid outlet of the fluid conduction means being coupled to ends of the distal arms opposite the articulation with the proximal arms.

2. The device according to claim 1, wherein the articulation actuator is one of a pneumatic actuator, a hydraulic actuator, an electric actuator and a manual actuator with an end coupled to the movable part and an end secured to the articulation.

3. The device according to claim 1, wherein the articulation actuator is a rod with an end secured to one of the distal arms and an end opposite extending out of the vessel, coupled to a crank.

4. The device according to claim 1, wherein the fixed part of the support base comprises:

a flange secured directly to the inner surface of the vessel by means of one of screws, rivets and soldering, and a tubular portion that extends from the flange, and the movable part has a tube segment that is coupled rotationally to the tubular portion of the fixed part.

5. The device according to claim 1, wherein the rotation actuator is coupled to the fixed part and to the movable part of the support base and has a drive mechanism that comprises an electric, pneumatic or hydraulic control and one of a drive gear, a belt and a chain for rotation of the movable part with respect to the fixed part, which engages with a gear mechanism of the movable part.

6. The device according to claim 5, wherein the rotation actuator has an electric control secured to the fixed part, and a gear chain driven by the electric control, which engages with gear teeth on the outer surface of the movable part.

7. The device according to claim 1, wherein the fluid conduction means has a length of at least 7 times as long as its diameter.

8. A fluid storage vessel, characterized by comprising at least a device for recovering residues and homogenizing fluid as defined in claim 1, which is installed inside the vessel, with the fixed part of the support base being rigidly secured to the vessel.

9. The vessel according to claim 8, wherein the fluid inlet of the fluid conduction means of the device communicates with a source of pressurized fluid out of the vessel through a rigid tube.

10. The vessel according to claim 8, characterized by being a hydrocarbon processing or storing tank.

11. A device for recovering residues and homogenizing fluids in a vessel, the device comprising at least:

a fluid conduction means with a fluid inlet and a fluid outlet, through which a pressurized fluid is injected into the vessel;

a support base to be secured to the vessel, which is provided with a central bore that communicates with the fluid inlet of the fluid conduction means, wherein:

the fluid conduction means is flexible;

the support base has a fixed part to be rigidly secured to the vessel, a movable part coupled rotationally to the fixed part and a guide structure for the fluid conduction means coupled to the movable part;

a rotation actuator is coupled to the movable part to cause it to turn together with the guide structure by up to 360 degrees around the axis of the support base;

the guide structure has an articulation by means of which the guide structure is articulable by about 180 degrees around an axis of said articulation;

an articulation actuator is coupled to the guide structure to actuate the articulation movement of the guide structure; and the rotation actuator is coupled to the fixed part and to the movable part of the support base and has a drive mechanism that comprises an electric, pneumatic or hydraulic control and one of a drive gear, a belt and a chain for rotation of the movable part with respect to the fixed part, which engages with a gear mechanism of the movable part.

12. The device according to claim 11, wherein the articulation actuator is one of a pneumatic actuator, a hydraulic actuator, an electric actuator and a manual actuator with an end coupled to the movable part and an end secured to the articulation.

13. The device according to claim 11, wherein the guide structure has two parallel proximal arms secured to the movable part and two parallel distal arms secured each to a proximal arm of said articulation, the fluid conduction means extending between the proximal and distal arms of the guide structure, and the fluid outlet of the fluid conduction means being coupled to ends of the distal arms opposite the articulation with the proximal arms, and wherein the articulation actuator is a rod with an end secured to one of the distal arms and an end opposite extending out of the vessel, coupled to a crank.

14. The device according to claim 11, wherein the fixed part of the support base comprises:

a flange secured directly to the inner surface of the vessel by means of one of screws, rivets and soldering, and a tubular portion that extends from the flange, and the movable part has a tube segment that is coupled rotationally to the tubular portion of the fixed part.

15. The device according to claim 11, wherein the rotation actuator has an electric control secured to the fixed part, and a gear chain driven by the electric control, which engages with gear teeth on the outer surface of the movable part.

16. The device according to claim 11, wherein the fluid conduction means has a length of at least 7 times as long as its diameter.

17. A fluid storage vessel, characterized by comprising at least a device for recovering residues and homogenizing fluid as defined in claim 11, which is installed inside the vessel, with the fixed part of the support base being rigidly secured to the vessel.

18. The vessel according to claim 17, wherein the fluid inlet of the fluid conduction means of the device communicates with a source of pressurized fluid out of the vessel through a rigid tube.

19. The vessel according to claim 17, characterized by being a hydrocarbon processing or storing tank.

* * * * *